United States Patent [19]

Willette et al.

[11] 4,310,160

[45] Jan. 12, 1982

[54] CARD SHUFFLING DEVICE

[76] Inventors: Leo Willette; Betty Willette, both of 3221 W. 135th St., Hawthorne, Calif. 90250

[21] Appl. No.: 186,177

[22] Filed: Sep. 11, 1980

Related U.S. Application Data

[63] Continuation-in-part of Ser. No. 74,090, Sep. 10, 1979, abandoned.

[51] Int. Cl.[3] ..... A63F 1/12

[52] U.S. Cl. ..... 273/149 R; 271/219

[58] Field of Search ..... 273/149 R; 271/4, 109, 271/219, 220, 264

[56] References Cited

U.S. PATENT DOCUMENTS

| | | | |
|---|---|---|---|
| 1,955,926 | 4/1934 | Matthaey | 273/149 R |
| 2,159,958 | 5/1939 | Sachs | 273/149 R |
| 2,706,117 | 4/1955 | Notz | 273/149 R |
| 2,717,782 | 9/1955 | Droll | 273/149 R |
| 2,753,185 | 7/1956 | Johnson | 271/220 |
| 3,975,010 | 8/1976 | Schisselbauer | 271/219 X |

*Primary Examiner*—Anton O. Oechsle

*Attorney, Agent, or Firm*—Francis X. LoJacono

[57] ABSTRACT

A device for shuffling a large number of cards, particularly playing cards in which the games played require the use of several decks that must be shuffled a number of times during continuous game play, the device comprising a housing having oppositely positioned feeding shelfs from which the cards are fed individually and alternately into a chute which is provided at its terminating end with a floating card rack. Within the housing there is provided a motor arranged to drive a plurality of timing gears, whereby a plurality of feeding rollers together with a plurality of conveyor rollers located within the card chute are driven so as to discharge the cards in a shuffled manner within the card-carriage tray.

4 Claims, 9 Drawing Figures

CARD SHUFFLING DEVICE

This is a continuation-in-part of application Ser. No. 74,090 filed Sept. 10, 1979 for CARD SHUFFLING DEVICE, abandoned.

BACKGROUND OF THE INVENTION

1. Field of the Invention

This invention relates generally to the shuffling of cards, and more particularly to a device for automatically shuffling several decks of cards in a continuous manner.

2. Description of the Prior Art

As is well known in the art of playing cards, various problems and difficulties are encountered in the shuffling of large quantities of playing cards, particularly when the type of game requires continuous and accurate shuffling during game play.

There are many established areas of legal gambling wherein various types of card games call for several decks to be used during game play. The number of individual cards makes it almost impossible to shuffle these particular stacks in one operation.

There is also difficulty in providing complete relocation of each individual card, whereby the cards cannot be dealt in the same order or sequence as in the previous hand.

Great care and time must be taken when shuffling three or four decks of cards. This means that there are between 156 and 208 cards, or more, that must be physically handled.

To solve the above problems, the applicant herein discloses an automatic-card-shuffling device, which to his knowledge is new and unique.

SUMMARY AND OBJECTS OF THE INVENTION

The present invention has for an important object the provision whereby several decks of playing cards can be readily and quickly shuffled, the shuffling device being motor driven and having oppositely positioned shelfs on which a substantially equal number of cards are placed so as to be alternately fed into the shuffling compartment which comprises a chute having drive rollers, the drive rollers being arranged to convey the cards to a carriage tray.

It is another object of the invention to provide a shuffling device that completely mixes the cards so that they are not dealt as in any previous sequence.

Still another object of the invention is to provide a device of this type that cannot be adjusted for selecting the shuffling arrangement of cards—thus making it tamper-proof.

It is a further object of the invention to provide a device of this character that is easy to service and maintain, and also easy to operate.

It is still another object of the invention to provide a card-shuffling device that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
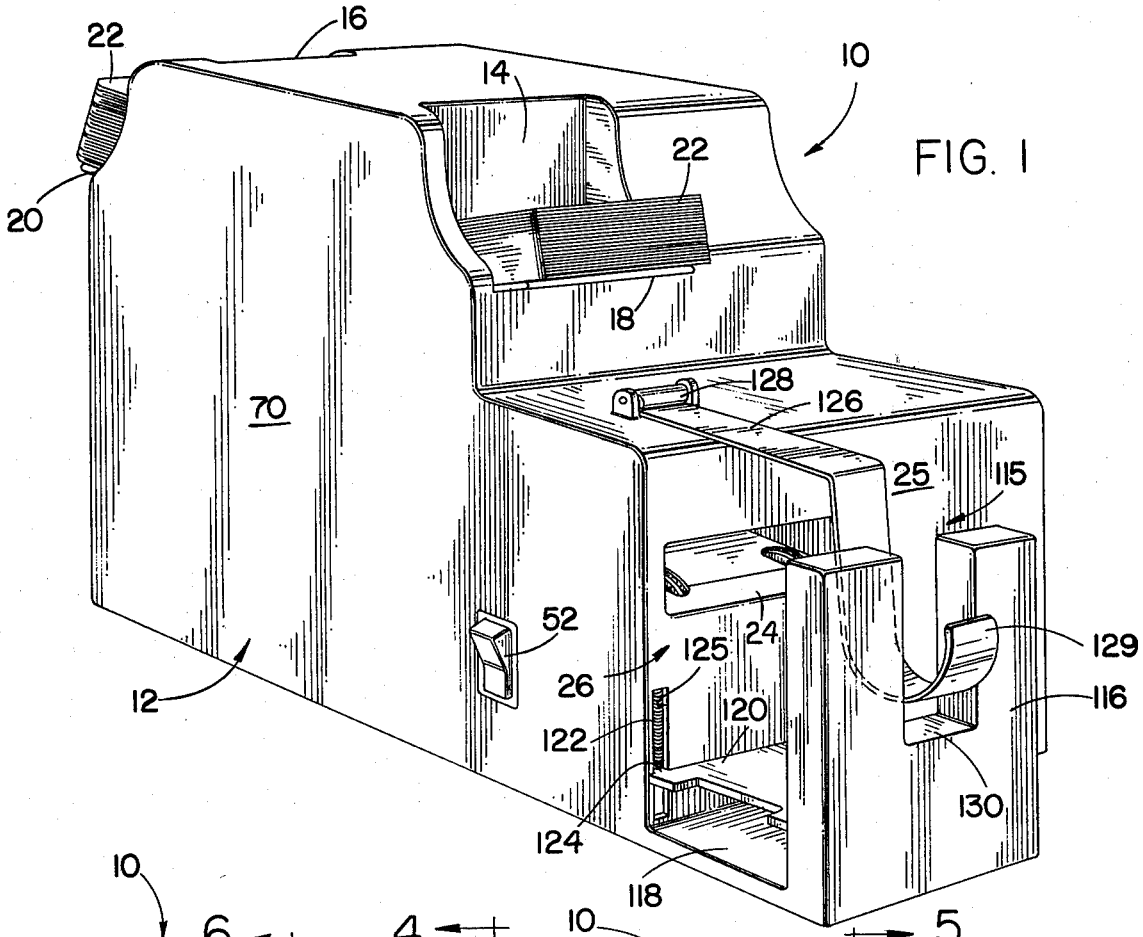
FIG. 1 is a perspective view showing the automatic card-shuffling device.
Figure 6:
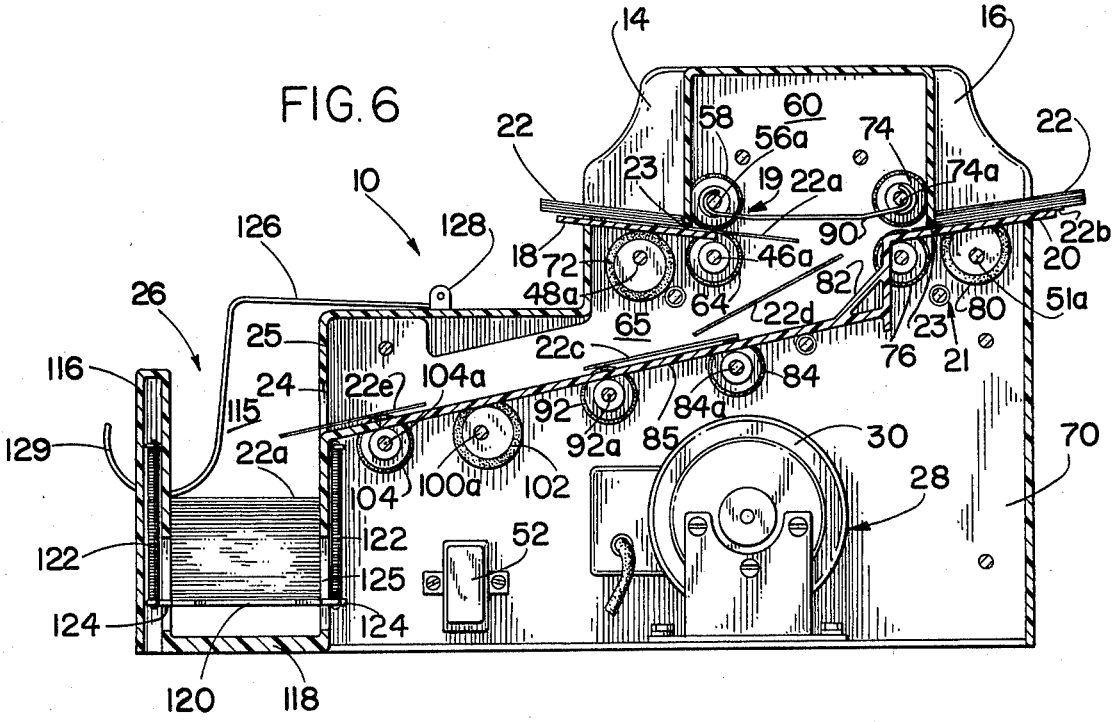
FIG. 6 is a cross-sectional view taken substantially along line 6—6 of FIG. 2, showing the cards being alternately fed into the card chute, and sequentially positioned in the carriage tray.

Referring more particularly to the drawings, there is shown an automatic-card-shuffling device, generally indicated at 10, having a housing 12 which is formed from any suitable material such as a lightweight plastic. Housing 12 includes first and second oppositely disposed recesses 14 and 16 which are provided with platforms or shelf members 18 and 20, respectively. As can be seen in FIGS. 1 and 6, shelf members are adapted to support a large number of playing cards 22 in respective recesses; and, from this point, the cards are fed through slots 23 and into the housing in a sequentially alternating manner by a first and second card-feeding means, generally indicated at 19 and 21, respectively. That is, one card at a time is removed from the bottom of each oppositely disposed stack of cards in an alternating sequence, whereby the cards are discharged through a discharge port 24 located in the front wall 25 of housing 12. Front wall 25 helps define a card-rack means, indicated generally at 26, wherein the shuffled cards are again stacked in a single group, as at 22, and are thus ready for game play.

Figure 2:
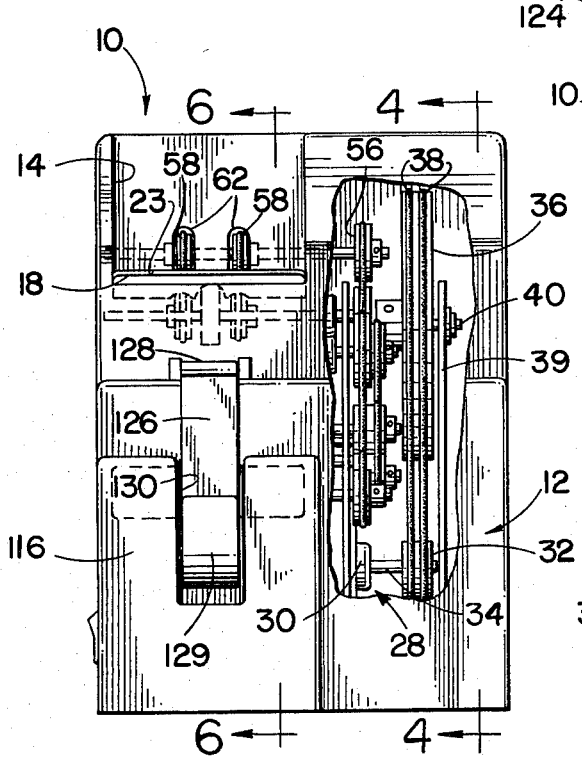
FIG. 2 is a front-elevational view with a portion of the housing broken away to illustrate the drive system therein.
Figure 3:
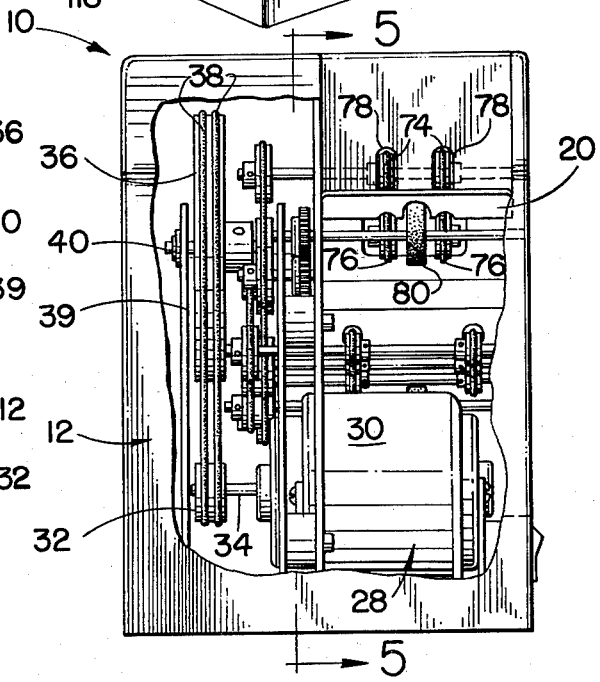
FIG. 3 is a rear-elevational view having a part thereof broken away to illustrate the drive system in more detail.
Figure 4:
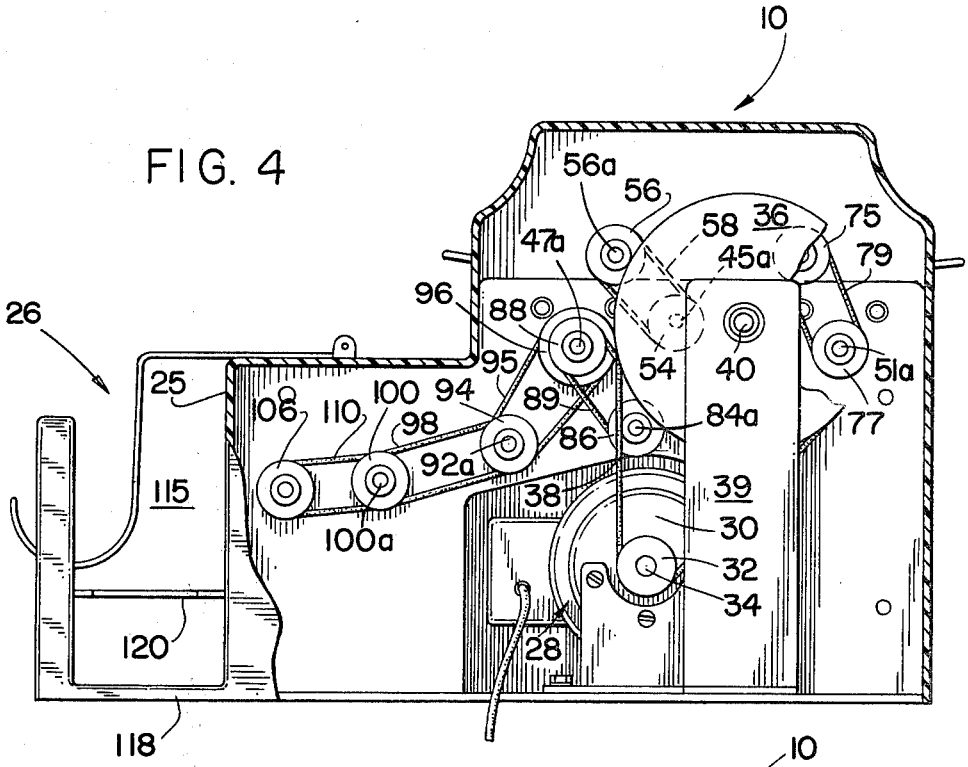
FIG. 4 is a cross-sectional view taken on line 4—4 of FIG. 2, showing the belt-and-pulley-drive system.
Figure 7:
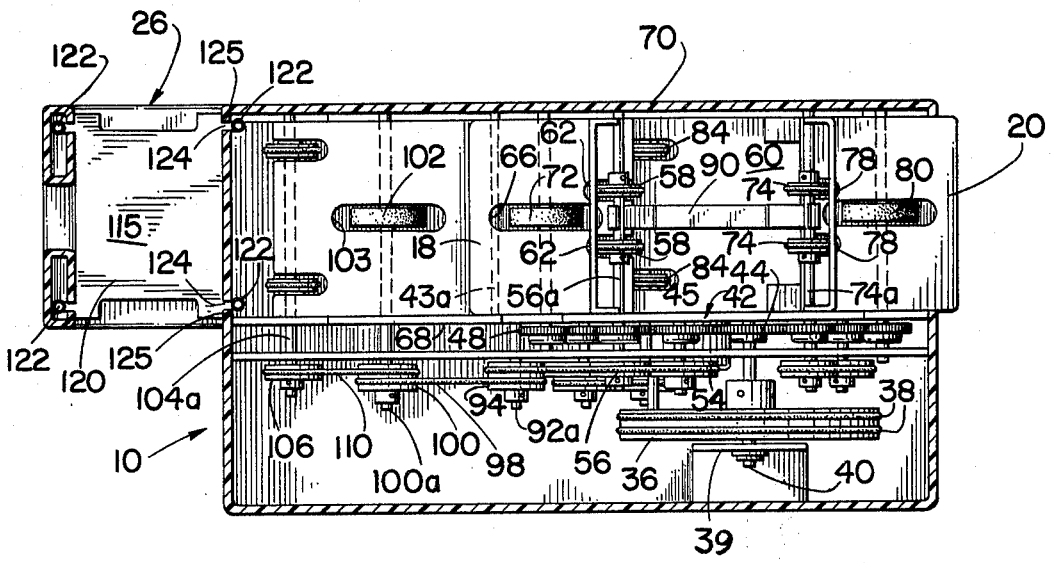
FIG. 7 is a top-plan view of the present invention with the upper portion broken away to illustrate the arrangement and position of the drive system and the card-feed rollers.

Referring now to the operation of the card-shuffling device, there is provided a drive means, generally indicated at 28, comprising an electric motor 30 which is adapted to be connected to a conventional power supply (not shown), the motor including a small drive pulley 32 mounted to output shaft 34 of motor 30. Pulley 32 is connected to a larger drive pulley 36 by belts 38, pulley 36 being operably supported by bracket 39 adapted to have journaled therein shaft 40 on which is fixedly mounted pulley 36, as seen in FIGS. 2, 3 and 7.

Figure 5:
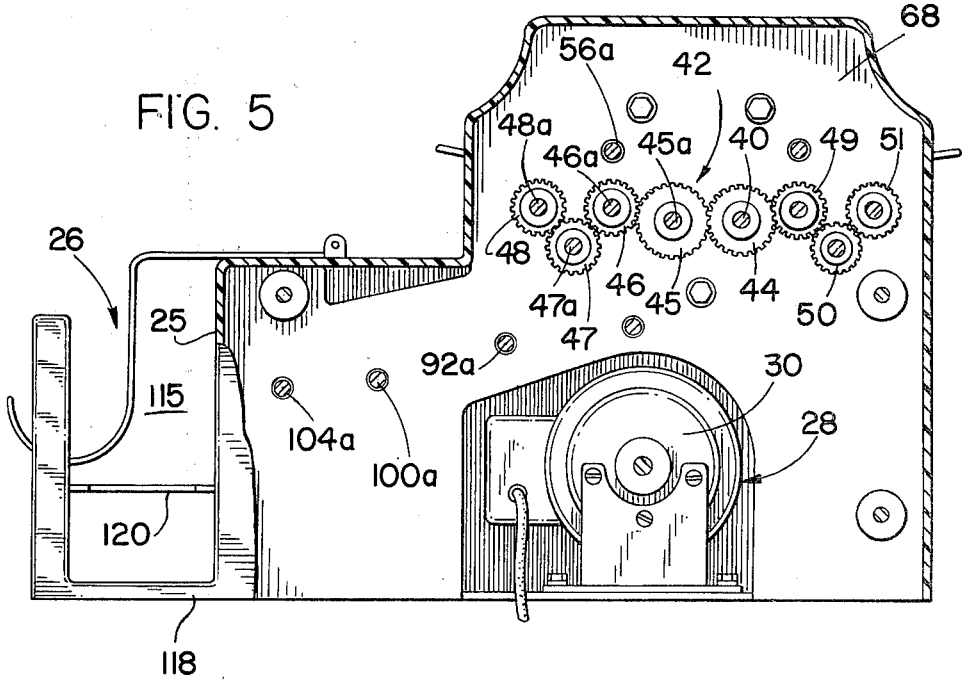
FIG. 5 is a cross-sectional view taken substantially along line 5—5 of FIG. 3, showing the arrangement of the gear train system.

Through the arrangement of drive means 28, a gear-train system, designated at 42, is operated to provide for a controlled synchronized movement of the card-conveyor means. That is, a first gear 44 of gear train 42 is affixed to shaft 40, which in turn drives the contiguously arranged gears 45 through 51, as seen in FIG. 5. These gears are further adapted to drive a plurality of friction rollers, forming the conveyor means for the playing cards.

In order for the operation of the card-shuffling device and its construction to be better understood, the following is a sequential description of the parts and their operational relationship to each other.

When cards 22 are positioned on respective shelf members 18 and 20, switch 52 is moved to "ON", thus activating motor 30. Hence, gear 44 begins to turn and drives the remaining gears 45 through 51. Second gear 45 is rotated, thus driving shaft 45*a* on which is mounted pulley 54. Pulley 54 is operably connected to pulley 56 by belt 58, pulley 56 being supported on shaft 56*a*. Also affixed to shaft 56*a* is a pair of friction rollers 58 positioned in the upper portion of the shuffling compartment 60, said rollers 58 being received in notches 62 of shelf 18. Rollers 58 are positioned just above the rear edge of shelf 18, a second pair of friction rollers 64 being located just below corresponding rollers 58. Rollers 64 are mounted to shaft 46*a* which is driven by gear sprocket 46 which engages gear 45.

Gear 46 also engages gear 47 which in turn drives gear 48, gear 48 being secured to shaft 48*a*. Shaft 48*a* extends across the lower card-shuffling portion 65 directly under shelf 18. Shaft 48*a* is journaled between inner partition 68 and side walls 70 of housing 12. Shaft 48*a* is provided with a drive-friction roller 72 which is eccentrically mounted thereto, the roller 72 being centrally located under shelf member 18 so as to be aligned with slot 66 formed in shelf 18, whereby roller 72 will pass through slot 66 during its eccentric rotation and frictionally engage the bottom card 22*a*, forcing it into engagement between rollers 58 and 64, as seen in FIG. 6. Thus, it can be understood that, each time frictional roller 72 engages a subsequent bottom card, the card is moved inwardly into the shuffling compartment 60.

To provide for the movement of bottom card 22*b* in recess 16, a second group of shuffling rollers is provided comprising an upper positioned pair of drive rollers 74 similar to rollers 58, and a lower pair of rollers 76 similar to rollers 74, rollers 74 and 76 being positioned within notches 78 in shelf 20. Rollers 74 are mounted to shaft 74*a*, pulley 75 being connected to pulley 77 affixed to shaft 57*a*, the pulleys being connected by belt 79. Further included therein is a second eccentric frictional roller 80 affixed to shaft 51*a*. Roller 80 intermittently engages card 22 in recess 16, forcing bottom card 22*b* into engagement with rollers 74 and 76. Shaft 58*a* includes gear 51 which is driven within the gear assembly, as shown. It should be noted that eccentric roller 72 is positioned oppositely 180° to that of eccentric roller 80. Accordingly, as shafts 48*a* and 51*a* rotate at the same RPM, the cards 22*a* and 22*b* will be engaged at 180° opposite intervals, thereby feeding the cards sequentially from recess 14 and from recess 16 into the shuffling compartments in an alternating manner.

As card 22*a* leaves rollers 58 and 64, it will abut against inclined wall 82 and engage a first set of conveyor rollers 84. Rollers 84 are positioned below the inclined partition 85 and are fixedly mounted to transverse shaft 84*a* which is operably rotated by pullies 86 and 88 through belt 89, pulley 88 being attached to shaft 47*a*.

Likewise, as card 22*b* leaves rollers 74, it is discharged into the shuffling compartments. However, the upper compartment 60 includes a centrally positioned guide bar 90 supported at its opposite end by shafts 56*a* and 74*a*.

Therefore, as card 22*c* moves towards opening 24, card 22*d* will follow and will first engage conveyor rollers 84. Each card is transferred to the next set of conveyor rollers 92, rollers 92 being supported by shaft 92*a* which is provided with pulley 94 connected by belt 94 to pulley 96, also affixed to shaft 47*a*. Pulley 94 is also arranged to receive belt 98 so as to drive pulley 100 which is mounted to shaft 100*a*, whereon there is secured an eccentric drive roller 102 centrally located under opening 103 in inclined partition or chute 85 so as to intermittently engage a card as it leaves rollers 92. This assures that each card is individually and sequentially passed over the last pair of conveyor rollers 104 wherein the cards are discharged into the card rack 26, one on top of the other. Rollers 104 are mounted on shaft 104*a* and are operated by pulley 106 attached to pulley 100 by belt 110, rollers 104 being located at the discharge end of chute 85 adjacent opening 24.

As the cards (such as 22*e*) are discharged through opening 24 from the chute, they are received and stacked in the card rack 26 which comprises a trough means 115 defined by front wall 25 of housing 12, an end wall 116 and a bottom member 118.

Movably positioned within trough 115, and transversely spaced between front wall 25 and end wall 116, is a free-floating carriage tray 120. Tray 120 is adapted to be supported by a plurality of spring members 122, as shown in FIGS. 1, 5 and 7. A pair of said springs are located behind wall 25, said springs having one end thereof secured to wall 25 and the lower end attached to card tray 120, said platform including projecting members 124 that pass through vertical slots 125. The opposite side of the carriage platform also includes projecting members 124 which are attached to a second pair of springs 122 located within end wall 116.

Thus, as the cards exit opening 24, they drop into trough 115 and rest on carriage tray 120. As the number of cards increases, the weight thereof causes the platform to lower itself against the biasing force of springs 122.

Accordingly, the top of the stack is positioned just below opening 24. This arrangement tends to prevent the cards from being flipped over on their face side during stacking. To further prevent the cards from flipping, there is provided a stack-control means comprising a pivoted arm 126 which is hinged at 128 and extends outwardly over trough 115, the arm being bent downwardly therein and terminating with a semicircular loop member 129. The loop member is also positioned within a slot 130 disposed in the end wall 116, whereby cards entering trough 115 engage loop 129 and slide between the loop and the last stacked card. Thus, arm 126 rises as the stack of cards increases in height, as indicated in FIG. 6.

When all the cards are shuffled and stacked in trough 115, they are simply removed after lifting arm 126 out of the trough.

Figure 8:
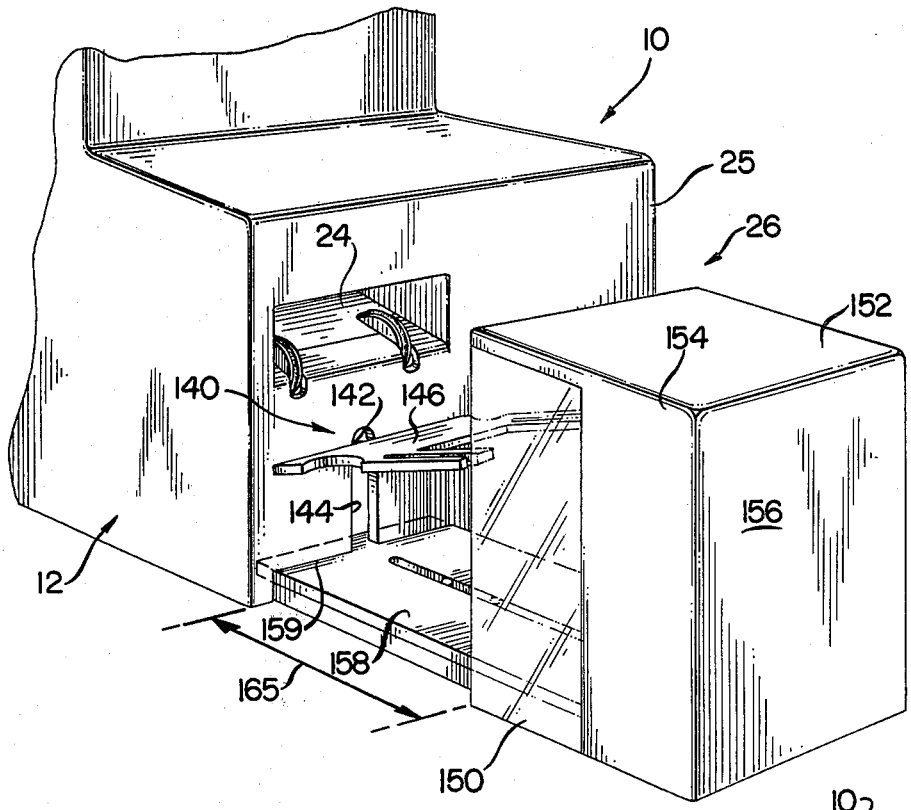
FIG. 8 is a perspective view of the front portion of the automatic card-shuffling device having a second embodiment of the card-receiving rack means.
Figure 9:
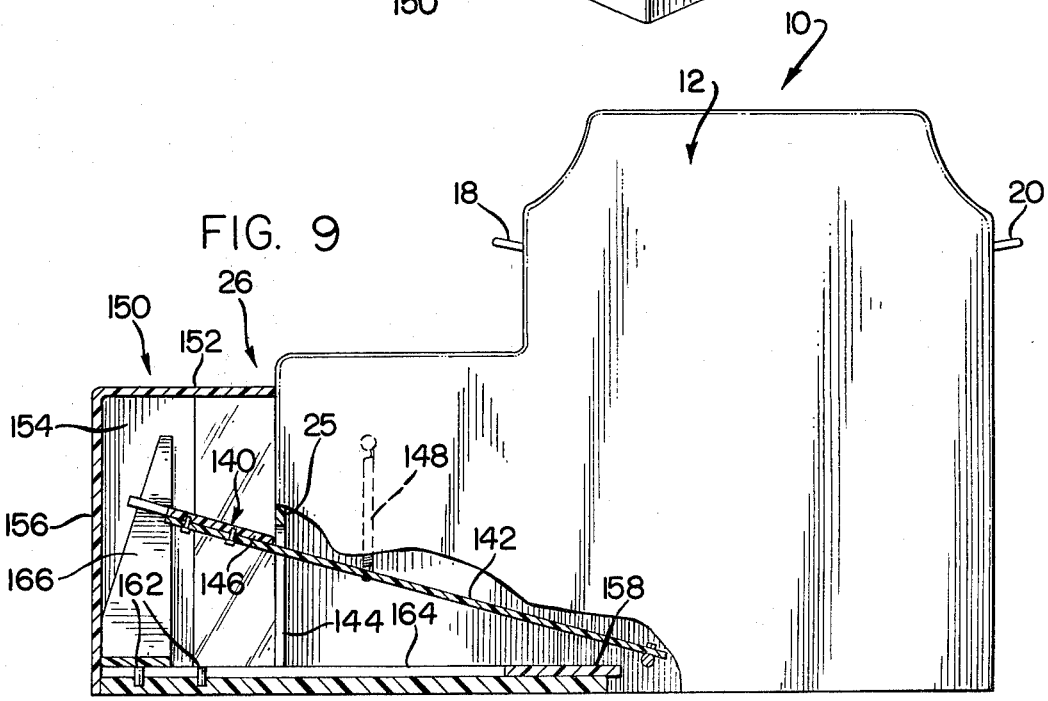
FIG. 9 is a side-elevational view thereof with a portion broken away, showing the card rack in a closed position prior to receiving cards therein.

Referring now to FIGS. 8 and 9, there is illustrated a second embodiment of the invention wherein the housing 12 is provided with a different arrangement of the card-rack means 26. In this arrangement, card-rack means 26 comprises a free-floating card carriage 140 formed by an elongated arm member 142 which is pivotally secured within housing 12 at the far end of the arm. The arm member 142 extends outwardly through vertical slot 144 formed in wall 25. The free extended end of arm member 142 is provided with a substantially flat tray 146. Tray 146 can be formed, as shown, as a separate part affixed to arm 142, or as an integral part thereof. Carriage 140 is adapted to be supported in a free-floating arrangement by spring 148 which is secured between housing 12 and arm member 142. This allows the arm and the tray to be positioned angularly upward in slot 144, whereby the carriage is allowed to move downwardly, as the shuffled cards are ejected from discharge port 24.

In order to restrict the incoming shuffled cards, there is further provided a movable closure, generally indicated at 150, which is arranged to slide in and out from the front of housing 12. Closure 150 comprises a box-like receptacle having an upper wall 152, side walls 154, and rear and bottom walls 156 and 158, respectively. At least a portion of each side wall 154 is formed with a clear material so that the cards are visible when stacked therein.

The bottom wall 156 defines an elongated member which extends inwardly from front wall 25, through horizontal opening 159, and rests on an extended bottom plate 160. A slide alignment means is provided having a pair of alignment pins 162 mounted to plate 160, the pins being adapted to fit within an elongated slot 164 centrally disposed in bottom wall 158. This allows closure 150 to slide in and out, indicated by arrow 165 in FIG. 8.

Secured to bottom wall 158 adjacent wall 156 are a pair of leg members 166 which provide a means for controlling the stacking of the cards as they are ejected from port 24. That is, each card ejected from port 24 engages legs 166 and then drops on tray 146. As the cards begin to stack, the weight thereof will cause carriage 140 to move downwardly against the force of spring 148. Thus, when all the cards have been shuffled, they have been orderly stacked on tray 146. At this time, closure 150 is moved outwardly, as seen in FIG. 8, and the cards are then removed for play.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. An automatic shuffling device for playing cards and the like, comprising:

a housing having a discharge opening with first and second recesses wherein stacks of cards are positioned, said recesses including transverse slots through which individual cards from said stacks can pass;

said housing including an upper shuffling portion to receive said cards from said recesses, and a lower shuffling portion which defines a chute through which said cards traverse to be discharged;

a first card-feeding means positioned adjacent said first recess to individually engage each bottom card of said stack therein, and feed said card through said transverse slot thereof;

a second card-feeding means positioned adjacent said second recess to individually engage each bottom card of said stack therein, and feed said card through said respective transverse slot thereof;

said first and second card-feeding means each comprising an upper set of frictional rollers, and a lower set of frictional rollers, said upper and lower sets of frictional rollers being positioned directly adjacent said transverse slot of said recess in order to engage said cards as they pass therethrough;

means for feeding said respective cards in an alternating sequential manner;

conveyor means within said housing positioned below said card-feeding means to transport said cards singularly from said housing through said discharge opening thereof, said conveyor means comprising a plurality of frictional rollers positioned within said chute to engage said cards as they pass from the upper portion to the lower portion of said housing;

a card rack located adjacent said discharge opening to receive said cards in a shuffled and stacked arrangement;

said card-rack means comprising a movable closure adapted to slide in and out of said housing adjacent said discharge end of said chute, and a floating card carriage pivotally secured to said housing and adapted to be positioned in said movable closure when said cards are being stacked thereon;

said floating card carriage comprising an elongated arm member pivotally secured within said housing and positioned to extend outwardly therefrom, and a flat tray mounted to the end of the extended portion of said elongated arm member thereof;

means for biasing said card carriage in an upward position, allowing said card carriage to move downwardly as said cards are stacked thereon;

sliding means formed between said housing and said movable closure;

means to automatically operate said first and second feed means and said conveyor means comprising a motor means, a gear-train system operably connected to said motor means, and a pulley system connected to and operated by said gear system, whereby said gear system and said pulley system are operably interconnected to said feeding means and said conveyor means.

2. An automatic-shuffling device as recited in claim 1, wherein said movable closure includes a stack-control means attached therein and positioned to be engaged by each card as it is discharged from said chute, whereby said cards are stacked in aligned shuffled order.

3. An automatic-shuffling device as recited in claim 2, wherein said sliding means comprises:

an outwardly extended bottom wall member of said housing;

guide pins mounted therein;

an inwardly extended bottom wall of said movable closure; and an elongated slot formed in said bottom wall of said movable housing and disposed to receive said pins therein, to allow longitudinal movement of said movable closure.

4. An automatic-shuffling device as recited in claim 3, wherein said stack-control means comprises a pair of vertically positioned leg members mounted to said bottom wall of said movable closure so as to move therewith.

* * * * *